United States Patent [19]

Abadi

[11] Patent Number: 4,702,824

[45] Date of Patent: Oct. 27, 1987

[54] ORE AND COAL BENEFICIATION METHOD

[76] Inventor: Khodabandeh Abadi, 5719 N. Camino Del Conde, Tucson, Ariz. 85718

[21] Appl. No.: 902,928

[22] Filed: Sep. 2, 1986

Related U.S. Application Data

[63] Continuation-in-part of Ser. No. 752,970, Jul. 8, 1985, abandoned.

[51] Int. Cl.[4] ..... B03D 1/02

[52] U.S. Cl. ..... 209/167; 252/61; 75/2

[58] Field of Search ..... 209/166, 167; 252/61; 75/2

[56] References Cited

U.S. PATENT DOCUMENTS 4,482,480 11/1984 Bresson et al. ..... 252/61

4,622,131 11/1986 Bresson et al. ..... 209/167

*Primary Examiner*—S. Leon Bashore

*Assistant Examiner*—Thomas M. Lithgow

*Attorney, Agent, or Firm*—Thomas H. Whaley

[57] ABSTRACT

This invention relates to a method of beneficiating coal or mineral ores containing a metaliferous sulfide, e.g. iron sulfide or pyrite, and comprises removal of unwanted components, including pyrite, from such ores by subjecting an aqueous pulp of the pulverized mineral or coal to a froth flotation process in which pyrites are depressed by a depressant composition comprising xanthan gum, a hydroxycarboxylic acid and sodium silicate. The process is especially useful for removal of pyrite from a solid carbonaceous fuel, e.g., coal containing pyrite, and for the recovery of non-ferrous metal concentrates from ores containing pyrite. The coal or ore may be subjected to a mild preoxidation treatment to enhance sulfide removal in the subsequent froth flotation operation.

14 Claims, No Drawings

ORE AND COAL BENEFICIATION METHOD

This is a continuation-in-part application of application Ser. No. 752,970 filed July 8, 1985 (Now Abandoned).

This invention relates to an improved method of beneficiating mineral ores and coal by froth flotation methods. In one of its more specific aspects, it relates to a method of enhancing the removal of pyrites, especially iron pyrite, from a mineral or coal containing pyrites, by froth flotation. In another of its more specific aspects, this invention relates to a method for upgrading the heating value and reducing the sulfur content of solid carbonaceous fuels, including various grades of coals containing undesirable components, e.g. non-combustible solids or ash. In still another of its more specific aspects, this invention relates to an improved method for the removal of iron pyrite from coal and non-ferrous components of metal ores by froth flotation.

The removal of sulfur from fossil fuels is becoming especially important as the available supplies of low sulfur fuel oils and coals are diminished. In many areas of the United States, for example, statutes and local ordinances mandate the use of low sulfur fuels. As a result, industrial users and utilities have been forced in many instances to convert from coal to low sulfur petroleum fuels, usually at great expense, both for conversion of equipment and increased fuel costs. At the same time, "acid rain" has plagued a wide area of the United States and parts of Canada as a result of industrial and domestic use of sulfur-containing fuels in the midwest and southwest sections of the United States. Sulfur emissions from the smokestacks are being carried by winds into other areas of the North American continent, particularly into the north and eastern sectors of the United States and into adjacent areas of Canada. Air pollution has become so serious that some industrial plants have been shut down and others have been forced to expand considerable sums of money for processes and equipment for removal of sulfur oxides from stack gases. Processes have been devised for the removal of sulfur from liquid and gaseous petroleum fuels, but insofar as known, relatively inexpensive methods for removal of sulfur containing compounds from solid fuels, especially coals, have not yet been devised. It is, therefore, a primary objective of this invention to provide a method for the removal of sulfur containing compounds, especially metal sulfides, e.g. iron pyrites, from coal and from various ores including copper and molybdenum ores.

In accordance with the method of this invention the mineral or coal, containing sulfur in the form of pyrites, including iron pyrite, is subjected to fine grinding, dispersed in water to form a "pulp", and subjected to froth flotation with air in the presence of a novel depressant for the pyrites and ash. The depressant employed in the process of my invention comprises a natural or synthetic polysaccharide gum, e.g., xanthan gum, a two to six carbon atom hydroxy carboxylic acid, and optionally sodium silicate, suitably an aqueous solution of xanthan gum, hydroxyacetic acid, and sodium silicate prepared as described in greater detail hereinafter. Substantial reductions in the contents of ash and sulfur compounds, especially iron pyrites, are obtainable as demonstrated hereinafter in specific examples.

The beneficiation of various minerals by froth flotation methods is well known in the art. For example, U.S. Pat. No. 4,139,455, incorporated herein by reference, discloses a process for beneficiation of metaliferous sulfide ores associated with pyrite, pyrrhotite, or sphalerite minerals, in which a tertiary amine polymer is used as depressants for the undesired pyrites in a froth flotation method. U.S. Pat. No. 4,098,686 relates to froth flotation as applied to ores containing vanadium, molybdenum, tungsten, and uranium minerals; U.S. Pat. No. 4,363,552 relates to beneficiation of ores of molybdenum and tungsten by froth flotation in which the molybdenum or tungsten is first oxidized with hydrogen peroxide or hydrogen persulfate, and oxalic acid or an alkali oxidate is used as a collector; while U.S. Pat. No. 4,206,878 relates to beneficiating iron ore by a series of processing operations including froth flotation.

I have now found that the removal of metal sulfides, especially iron pyrites, from a mineral or a solid carboniferous fuel, e.g. coal, by froth flotation may be carried out effectively by the use of a composition comprising an aqueous solution of hydroxyacetic acid as a suppressant for pyrites. Although pure hydroxyacetic acid is not commercially available, the commercial acid comprising 30 weight percent water and 70 weight percent acid, throughout this specification wherever concentrations are expressed in percentages acid by weight, the basis is undiluted acid or 100 percent hydroxyacetic acid.

A preferred depressant composition comprises hydroxyacetic acid; a polysaccharide, e.g., xanthan gum; and sodium silicate in an aqueous solution. The acid component may comprise from about 0.1 to about 69 percent by weight of the composition; the xanthan gum, from about 0.01 to about 10 percent by weight of the composition; while the ratio by weight of sodium silicate to acid is preferably in the range of about 0 to about 0.5. A preferred composition is one in which the hydroxyacetic acid concentration is in the range of 3 to 35 percent by weight; the polysaccharide is xanthan gum at a concentration in the range of 0.05 to 5 percent by weight and the ratio by weight of sodium silicate to acid is in the range of 0.02 to 0.4. A specific preferred composition for treating coal and ore is one in which the acid comprises about 33 percent by weight of the composition, the xanthan gum, about 0.3 weight percent, and the sodium silicate about 1 weight percent of the aqueous solution.

The xanthan gum may be granular in form and coated with glyoxal (e.g., the product sold under the trade name Kelzan S by the Kelco Division of Merck & Co., Inc.) as an aid in dispersing the granules of gum in water expediting the solution of the xanthan gum in water. The xanthan gum may comprise from about 0.01 to about 10 percent by weight of the aqueous composition, depending to some extent upon the pH of the slurry or pulp, but usually is within the range of 0.2 to 0.5 weight percent of the composition. The pH of the flotation step is carried out in the range of 5–12.

Xanthan gum as employed in the depressant composition in the method of this invention is unique in its ability to impart certain properties to the composition. Without wishing to limit in any way the scope of my invention, it is postulated that the polysaccharide shape represented typical of xanthan gum forms a reaction product with the hydroxycarboxylic acid which acts as a sequestering agent or ion exchange agent in the composition. Although xanthan gum is a commonly used thickener, its function in the composition is more than that of a thickener. That is to say, other xanthan gum appears to have an active reagent function in the depressant composition.

The depressant compositions of the present invention has been found especially useful in enhancing the removal of iron pyrites from copper and molybdenum ores and carbonaceous fuels subjected to conventional froth flotation processes for beneficiation of such mineral ores.

In preparing the depressant composition, the order of mixing the ingredients is as follows: first the xanthan gum is added to water with thorough mixing to dissolve the gum prior to adding other components; secondly, sodium silicate is added to the xanthan gum solution; and, finally, the hydroxy aliphatic carboxylic acid is added with mixing until a homogenous composition is achieved.

In carrying out the method of my invention, the coal or metaliferous ore containing metal sulfides, e.g. iron pyrites, in discrete particle form, is pulverized, mixed with water to form a pulp, and subjected to a conventional froth flotation procedure. Test results indicate that pulverization of the ore to the extent that 99+ weight percent passes a 100 mesh sieve and about 30 weight percent passes a 325 mesh sieve (U.S. Standard Screen Series), is adequate for effective removal of a substantial percentage of the iron pyrites from coal by froth flotation in the presence of the composition of this invention. Smaller particle sizes tend to improve separation of pyrites, but the incremental improvement may not warrant increased costs of processing. In the method of this invention, a novel depressant composition which comprises a hydroxyacetic acid, a polysaccharide, and sodium silicate, is added to the pulp. The preferred polysaccharide is xanthan gum. Preferred concentration ranges of the components, relative to the dry basis weight of the ore or coal, may be within the range of from about 0.02 to about 1 pound hydroxyacetic acid; from about 0.001 to about 0.01 pound xanthan gum; and from about 0.001 to about 0.1 pound sodium silicate per ton of coal.

When coal or ore is mined by surface mining methods, e.g. strip mining methods, exposure to the air results in some spontaneous oxidation sulfur containing compounds contained therein as well as oxidization of coal containing the compounds. When mined from underground seams, mild oxidation may occur during storage above ground. In either event, some oxidation of the metaliferous components of the ore or coal takes place. The rate and extent of oxidation increases in the presence of moisture. It is believed that the effectiveness of the method of this invention for removal of metaliferous sulfur compounds from ores is related to some extent to the degree of oxidation of the metaliferous sulfur-containing components of the ore or coal. To increase the extent of such oxidation, the ore or coal may be subjected to a preoxidation treatment including, inter alia, exposure to air and moisture; bacterial action by certain known bacteria; or to a chemical preoxidation treatment, e.g. preoxidation with hydrogen peroxide. Although other chemical oxidizing agents, such as oxalic acid and alkali oxidates, are known, one preferred embodiment of the method of my invention comprises pretreatment of the ore or coal with hydrogen peroxide. The amount of hydrogen peroxide employed, expressed as pure hydrogen peroxide, may vary within the range of from about 2 to about 40 pounds per ton of coal.

The present invention will be further illustrated by means of the following examples. It is to be understood, however, that these examples are merely for illustrative purposes and that the present invention is not meant to be limited thereby. In the following examples and throughout this specification, the quantities of material are expressed in terms of parts by weight, unless otherwise specified.

EXAMPLE 1

A five gallon batch of a depressant composition suitable for use in the method of this invention was prepared by mixing 0.115 pound of xanthan gum (sold under the trade name Kelzan S) with 28.3 pounds of water until a homogeneous solution was obtained. Then 0.425 pound of sodium silicate was added and mixed until dissolved, followed by an addition of 14.1 pounds of a 70 percent by weight hydroxyacetic acid solution. The resulting mixture, designated herein as Composition A, had the following approximate composition in percentages by weight.

TABLE 1

| Composition A | |
|---|---|
| Component | Weight % |
| Hydroxyacetic Acid | 23.0 |
| Sodium Silicate | 1.0 |
| Xanthan Gum | 0.3 |
| Water | 75.8 |

This composition was used as a depressant for pyrites in the flotation of coal in the following examples.

Several tests were made to determine the extent of sulfur removal obtainable by the process of this invention. In each of the following examples 2–6, the coal tested is a high sulfur content coal from the Quality Coal Company, Starr Township, Hocking County, Ohio, designated Lower Freeport, Seam No. 6A. This coal, which contains iron pyrites and has a pH in the neutral or alkaline region when mined, changed to an acid pH on exposure to air for an extended period of time.

In the test runs forming the basis for the following specific examples, 500 gram samples of coal were pulverized in a rod mill with water at 60% by weight solids concentration to 99+ weight percent passing a 100 mesh sieve and about 30 weight percent retained on a 325 mesh sieve. A sample of the 100 mesh material was assayed for ash and sulphur by ASTM Methods D 3174-82 and D 3177-75 and found to contain 4.4 weight percent sulphur and 15.8 weight percent ash. Microscopic examination of the rod mill ground coal showed that appreciable amount of sulphur contained in the coal was in the form of pyrite.

A series of test separations were made both with and without the addition of the depressant Composition A of this invention to the pulp to observe visually the effect of this composition on the removal of iron pyrites from the Ohio coal identified hereinabove. The 100 mesh coal was floated at two pulp densities 20 and 10 percent in 2000 and 4000 milliliter standard Denver Equipment Co. laboratory flotation cells, respectively. The pulp was conditioned for 5 minutes with fuel oil and methyl isobutyl carbinol (MIBC). In those tests employing Composition A, five minute conditioning was also employed with Composition A in varying amounts depending upon the total quantity added.

EXAMPLE 2

The first control float was conducted with 20 percent solids using 1.5 lbs/ton of fuel oil and 0.9 lbs/ton MIBC at 23° C. The pH of this float was 6.1. The fuel oil and MIBC were added at different stages during the float to minimize the entrapment of ash and pyrite in the froth.

Control tests were first carried out on 100 mesh material at a pulp density of 20 percent. Evaluations were run without the depressant to establish a control reference point. Without the addition of the depressant, the flotation control concentrate contained 3.9 percent sulphur and 9.42 ash and the tail contained 14.3 percent sulphur and 73.49 percent ash. When 0.14 pounds per ton of Composition A was stage added to the float, the sulphur content of the concentrate dropped to 3.7 percent and the ash to 8.01 percent.

When the coal was floated at 20 percent solids, the froth generated was very heavy causing entrapment of ash and sulphur. To avoid this problem, the solids content of subsequent flotation tests was reduced to 10 percent. The concentrate generated without a depressant at 10 percent solids contained 3.8 percent sulphur. When 0.2 pound per ton Composition A was added to the float, the sulphur content of the coal concentrate was reduced by 20 percent to 3.0 percent sulphur. Additions of Composition A in concentrations greater than 0.2 pounds per ton did not significantly improve sulphur rejection or the ash content of the coal concentrates.

The observed results of the tests on reduction of iron pyrites are summarized as follows.

TABLE 2

| Concentration of Composition A, Lb/Ton | Observed Effect |
|---|---|
| 0.1 | Ineffective |
| 0.1 | Little Effect |
| 0.14 | Reduced 10% |
| 0.2 | Reduced 20% |
| 1.0 | No Advantage Over 0.2 |

EXAMPLE 3

A two stage rougher and cleaner float was conducted on a 500 gram sample of the coal which was rod mill ground for 10 minutes. Both the rougher and cleaner floats were conducted with 0.2 lb/ton Composition A. Conditioning time for both tests was 5 minutes with 0.04 lb per ton Composition A. The remaining 0.16 lb/ton of Composition A was stage added during the float. The cleaner coal concentrate from this test contained 2.62 percent sulphur, a 40 percent reduction in sulfur content as compared with the untreated sample.

EXAMPLE 4

The ability of Composition A to act as a depressant/-dispersant for pyrite was compared to sodium cyanide, a standard pyrite depressant. Sodium cyanide was stage added to the float at 0.4 lbs/ton. The concentration of pyrite contained in the coal concentrate after the addition of sodium cyanide to the float was slightly higher than the pyrite content achieved by adding 0.14 to 0.2 lbs of Composition A to the coal float.

EXAMPLE 5

Froth flotation samples run without the addition of Composition A required 35 minutes of froth flotation to complete the separation. When an effective amount of Composition A was added to the pulp, the separation was complete in 25 minutes.

EXAMPLE 6

In this example, the coal pulp was pretreated with aqueous hydrogen peroxide prior to flotation.

A 500 gram sample of the coal of Example 2 was pulverized in a rod mill with 300 ml of water for 10 minutes. On analysis, 31.5 weight percent of the pulverized coal particles passed a 325 mesh sieve. The resulting pulp mixture was diluted with water to a 10 weight percent solid pulp and successively treated at room temperature at 5 minutes intervals with four and 5 ml additions of aqueous hydrogen peroxide (3 weight percent hydrogen peroxide) under conditions of constant agitation. The reaction with hydrogen peroxide was monitored by determination of the pH of the pulp before and after the addition of hydrogen peroxide until a stable pH condition was reached. The measured pH of the pulp (at time 0) before addition of hydrogen peroxide was 4.5. The test results are shown in the following table.

TABLE 3

| Time (Min.) | pH (before $H_2O_2$) | pH (after $H_2O_2$) |
|---|---|---|
| 0 | 4.5 | 3.4 |
| 5 | 4.7 | 3.8 |
| 10 | 3.9 | 3.5 |
| 15 | 3.5 | — |

As seen from the above table, following hydrogen peroxide addition at the end of 10 minutes treatment the pH was 3.5 which remained unchanged at the end of 15 minutes indicating that no further reaction was taking place.

The resulting pulp was subjected to air flotation in a 4000 ml Denver Equipment Co. laboratory flotation cell using 0.5 grams of methyl-isobulytcarbinol (MIBC) as a frothing agent, 1.5 grams of a mineral fuel oil as a collector and 0.15 grams of Composition A as a suppressant for iron pyrites. The overhead (coal) fraction amounted to 97.48 weight percent of the initial coal charge while the rough tail fraction consisted of 2.52 weight percent of the charge. The rough tail fraction was collected and the overhead fraction refloated.

The overhead fraction was diluted with water to bring the pH to 7.0 and treated with 5 ml of aqueous hydrogen peroxide containing 3 weight percent hydrogen peroxide thereby reducing the pH to 6.6. After 5 minutes agitation, the pH remained at 6.6. A second 5 ml addition of the aqueous hydrogen peroxide was added to the pulp; after five minutes agitation, the pH remained at 6.6. After a third 5 ml addition of the aqueous hydrogen peroxide and further 5 minutes agitation, the pH was 6.8.

Reflotation of the overhead fraction was started at a pH of 6.8 using 1 gram fuel oil, 0.475 grams of MIBC; 0.15 grams of Composition A; and 5 ml aqueous hydrogen peroxide (3%). During the reflotation process, additional doses of the aqueous hydrogen peroxide (3%) were added in 10 ml increments, with two additions during the first 5 minutes with four more additions at successive 5 minute intervals. The clean tail fraction amounted to 5.16 weight percent of the refloated overhead fraction. The results are summarized in the following table.

TABLE 4

| Ash and Sulfur Contents of Samples | | |
|---|---|---|
| Sample | Wt % Ash | Wt % S |
| As Received | 15.8 | 4.4 |
| Rough Tail | 74.68 | 11.4 |
| Clean Tail | 57.64 | 18.6 |
| Cleaner Concentrate | 11.02 | 3.27 |

Approximately 26 weight percent of the pyrites in the coal sample were removed by the method of this invention as demonstrated in this example.

EXAMPLE 7

Several test runs were carried out to determine the effectiveness of the pyrite suppressant compositions of this invention as applied to recovery of copper and molybdenum from copper ores.

In this example, copper ore from the Cyprus mine in the Green Valley area, Arizona, was used as the source of the ore samples.

In these examples, 500 gram samples of the ore were pulverized in a ball mill containing a 22 pound charge of balls of varying size, to a particle size such that 70 percent passed a 100 mesh (U.S. Sieve Series) standard screen sieve. Test separations were made in Agitair, Model LA-500 laboratory froth flotation unit and the float and tail fractions analyzed to determine the extent of recovery and concentration of copper and iron in the float.

Prior to testing the depressant composition of this invention, a first control float (Run 33) was carried out with a 500 gram sample of Duval ore from the Cyprus mine assaying 0.3 weight percent copper, 2.19 weight percent iron, and 1.39 weight percent sulfur.

The ore was pulverized in the ball mill with sufficient water to produce a pulp containing 67 weight percent solids. The pulp was conditioned for 5.5 minutes in the ball mill with the addition of 0.56 gram CaO (equivalent to 2.24 pounds CaO per ton of ore) and with amounts of sodium isopropyl xanthate (SIX) and fuel oil equivalent to 0.03 and 0.0002 pounds per ton of ore, respectively. The pulp was transferred to a 2000 ml standard flotation cell, and the equivalent of 0.0008 pound per ton of methyl isobutuyl carbinol (MIBC) added to the pulp with mixing for 3 minutes before starting the air for froth flotation. The measured pH of the pulp was 10.6.

The preconditioned pulp was subjected to froth flotation for 3 minutes, with removal of float, designated herein as Rougher No. 1; then an additional amount of sodium isopropyl xanthate (SIX) equivalent to 0.02 pound per ton was added with stirring for one minute before continuing air froth flotation for an additional 3 minutes, with removal of float, designated Rougher No. 2. The two float fractions were combined and the float and tail fractions assayed with the results shown in the following table.

TABLE 5

| | TOTAL | ASSAYS, Wt. % | | | RECOVERY, Wt. % | | |
|---|---|---|---|---|---|---|---|
| | Wt. % | Fe | Cu | S | Fe | Cu | S |
| Float | 7.26 | 13.0 | 3.93 | 11.98 | 42.92 | 93.33 | 62.6 |
| Tails | 92.74 | 1.35 | 0.02 | 0.56 | 57.08 | 6.67 | 37.4 |

As indicated in the above table, 93.33 weight percent of the copper in the ore was recovered with 42.9 percent of the iron and 62.6 percent of the sulfur contained in the ore.

A second comparison test was run (Run 32) with the addition of the equivalent of 4 pounds of lime (CaO) per ton, initial pH 11.4. Analysis of the float showed recovery of copper of 93.1 weight percent; iron, 30.19 weight percent; and sulfur, 27.6 weight percent.

EXAMPLE 8

Tests were conducted with the addition of pyrite depressant of this invention (Composition A of Example 1) to determine whether satisfactory recoveries of metal values from copper ores may be obtained at norman pH values of the pulp without the need for lime addition to the pulp. An additive composition was prepared in accordance with the method of Example 1 having the following composition:

| Composition B | |
|---|---|
| Component | Wt. % |
| Hydroxyacetic Acid | 8.25 |
| Sodium Silicate | 0.99 |
| Xanthan Gum | 0.27 |
| Water | 90.49 |

A test (Run 44) was carried out with a 250 gram sample of Duval ore in a 1000 ml test cell under the same conditions as Example 7 except that no CaO was added to the pulp, the pulp was pretreated with 0.2 pound per ton Composition B and with 0.06 pound per ton (lb/T) SIX, at an initial pH of 8.0. An additional 0.03 lb/T SIX and 0.0001 lb/T MIBC were added after the first flotation.

Results are shown in the following table:

TABLE 6

| | | RECOVERY, Wt. % | |
|---|---|---|---|
| | WEIGHT % | Fe | Cu |
| Floats | 6.59 | 26.04 | 88.46 |
| Tails | 93.41 | 73.96 | 11.54 |

Comparison of this example with Run 33 of Example 7 indicates that comparable recoveries of copper were obtained with suppression of iron in the float at the normal pH of the pulp pyrite depressant composition of this invention while eliminating the need for lime addition to the pulp.

EXAMPLE 9

The float from a test run (Run 72) made under the conditions described in Examples 7 and 8 was analyzed to determine the extent of molybdenum recovery obtainable when the pyrite suppressant of my invention is employed for recovery of copper and molybdenum from copper ore. Molybdenum associated with copper in the ore is simultaneously concentrated in the float.

In this example, the pyrite suppressant of Composition B was added in an amount equivalent to only 0.025 lb/T and potassium amyl xanthate (PAX) was substituted for sodium isopropyl xanthate (SIX). The amount of the PAX addition was equivalent to 0.0075 lb/T; aromatic oil equivalent to 0.04 lb/T was used instead of fuel oil as a collector for molybdenum with the addition also of 0.005 lb/T of an oil soluble industrial additive sold under the trade name Aero 3302 by American Cyanamide Company. The initial pH was 7.5. Results of the analysis of the floats were as follows:

| RECOVERY, Wt. % | | |
|---|---|---|
| Fe | Cu | Mo |
| 25.96 | 81.47 | 69.12 |

Throughout these examples, 7 to 9, the 500 gram samples are run in a 2000 ml test cell of the Agitair flotation unit at 67 weight percent pulp density as described in Example 7.

EXAMPLE 10

Composition B of Example 8 was tested for enhancement of recovery of molybdenum from molybdenum ore obtained from plant of MolyCorp, Inc., Questa, N.M.

The ore samples analyzed approximately 0.13 weight percent molybdenum, 0.014 weight percent lead and 2 weight percent iron. In each of the following tests, a 500 gram sample of ore was milled for 5 minutes in a rod mill with sufficient water to produce a pulp containing 66 weight percent solids to 70 weight percent passing a 100 mesh sieve screen with the addition of fuel oil equivalent to 0.24 lb/T; pine oil equivalent to 0.06 lb/T; MIBC equivalent to 0.05 lb/T; an industrial reagent sold under the trade name D-8 by Phillips Petroleum Company as an agent for enhancing recovery of molybdenum equivalent to 0.16 lb/T; and Composition B equivalent to 0.13 lb/T.

In each of the following test runs, the pulp was conditioned in the flotation test cell for one minute before beginning the froth flotation. Two stage rougher flotation tests were conducted with one minute conditioning between floats during which an additional amount of D-8 equivalent to 0.16 lb/T and an additional amount of Composition B equivalent to 0.05 pound per ton were added to the pulp in the flotation test cell. The first rougher float was carried out in eight minutes while the second lasted four minutes. The floats were combined and the results of analysis of the combined floats for each test are shown in the following table.

TABLE 7

| | RECOVERY, Wt. % | | |
|---|---|---|---|
| RUN NO. | Mo | Pb | Fe |
| 102 | 91.23 | 19.65 | 8.44 |
| 103 | 91.86 | 15.93 | 6.73 |
| 104 | 92.42 | 21.85 | 8.69 |
| Average | 91.84 | 19.14 | 7.95 |

The foregoing examples demonstrate the suitability of my composition for suppressing sulfides of iron in froth flotation processes for the concentration of metal values in ores containing pyrites. Among the classes of ores to which the method of this invention may be applied are sulfide ores including copper ores, copper-molybdenum ores, lead-zinc ores, lead-zinc-iron ores, copper-lead-zinc-iron ores, gold-silver ores, copper and lead oxide ores, as well as non-sulfide ores including fluorite and tungsten ores.

In flotation processes for recovery of copper, the additive composition of this invention eliminates the need for the use of lime (CaO) in the process at a savings in reagent cost. In the case of molybdenum ores, my additive composition eliminates the need for the use of phosphorus pentasulfide and sodium hydroxide, saving the cost of these reagents as well as avoiding the health hazards and disposal problems created by the use of such reagents.

Due to variations in the compositions of natural mineral ores, it is advisable to test several compositions of the pyrite depressant to determine the particular compositions within the ranges disclosed herein which are most effective and to utilize the dosage of the selected pyrite depressant composition which provides optimum recovery of desired metal values by froth flotation while suppressing the undesirable metal components in the float fractions.

I claim:

1. In a method for the separation of iron pyrite from a pulverized mineral ore comprising iron pyrites as a first constituent and a second constitutent selected from the group consisting of coal and non-ferrous metal ores by air froth flotation of an aqueous pulp of said pulverized mineral ore, the improvement which comprises incorporating in said pulp from about 0.02 to about 1 pound per ton of mineral of a composition comprising hydroxyacetic acid, xanthan gum, sodium silicate, and water wherein the acid content of the composition is from about 0.1 to about 69 percent by weight of the composition, the xanthan gum is from about 0.01 to about 10 percent by weight of the composition; and the ratio by weight of sodium silicate to hydroxyacetic acid is in the range of from about 0 to about 0.5.

2. A method according to claim 1 wherein the second constituent is coal.

3. A method according to claim 1 wherein the second constituent is copper.

4. A method according to claim 1 wherein the second constituent is molybdenum.

5. A method according to claim 1 wherein the acid content is within the range of from about 3 to about 35 percent by weight of the composition.

6. A method according to claim 1 wherein the xanthan gum content of the composition is in the range of from about 0.05 to about 5 percent by weight of the composition.

7. A method to claim 6 wherein the xanthan gum content is in the range of about 0.2 to about 0.5 percent by weight of the composition.

8. A method according to claim 2, wherein the flotation is carried out at a pH in the range of 5 to 12.

9. A method according to claim 1 wherein the concentration of hydroxyacetic acid is in the range of from about 3 to about 35 percent by weight of the composition, the concentration of xanthan gum is in the range of from about 0.2 to about 0.5 percent by weight of the composition and the ratio by weight of the sodium silicate to acid is in the range of from about 0.02 to about 0.04.

10. A method according to claim 1 wherein the mineral ore is subjected to mild preoxidation prior to separation of iron pyrites therefrom by froth flotation.

11. A method according to claim 2 wherein the aqueous pulp of pulverized mineral ore is treated with hydrogen peroxide at a dosage within the range of from about 2 to about 10 pounds hydrogen peroxide per ton of coal.

12. A method according to claim 2 wherein the mineral ore in the aqueous pulp has a particle size smaller than about 100 mesh or about 150 microns.

13. A method according to claim 3 wherein the mineral ore in the aqueous pulp has a particle size such that about 70 percent passes a 100 mesh standard sieve series screen.

14. A method according to claim 4 wherein the mineral ore in the aqueous pulp has a particle size such that about 70 percent passes a 100 mesh standard sieve series screen.

* * * * *